US005203366A

United States Patent [19]

Czeck et al.

[11] Patent Number: 5,203,366

[45] Date of Patent: Apr. 20, 1993

[54] APPARATUS AND METHOD FOR MIXING AND DISPENSING CHEMICAL CONCENTRATES AT POINT OF USE

[75] Inventors: Stephen J. Czeck, Shoreview; Douglas S. Hoerning, Crystal; Richard J. Mehus, Minneapolis; Timothy A. Gutzmann, Eagan; Richard O. Ruhr, Buffalo, all of Minn.

[73] Assignee: Ecolab Inc., St. Paul, Minn.

[21] Appl. No.: 831,564

[22] Filed: Feb. 5, 1992

[51] Int. Cl.[5] ..... B67D 5/60

[52] U.S. Cl. ..... 137/3; 137/341; 137/624.11; 137/625.41; 222/144.5

[58] Field of Search ..... 222/144.5, 146.5; 137/341, 625.41, 624.11, 1, 3

[56] References Cited

U.S. PATENT DOCUMENTS

| | | | |
|---|---|---|---|
| 2,823,833 | 2/1958 | Bauerlein . | |
| 3,034,685 | 5/1962 | Breitenstein . | |
| 3,460,717 | 8/1969 | Thomas . | |
| 3,670,785 | 6/1972 | Heiss | 141/9 |
| 3,797,744 | 3/1974 | Smith . | |
| 3,826,905 | 7/1974 | Valkama et al. . | |
| 3,930,598 | 1/1976 | Slagle . | |
| 4,090,475 | 5/1978 | Kwan | 222/144.5 |
| 4,163,523 | 8/1979 | Vincent . | |
| 4,372,666 | 2/1983 | Kaufmann . | |
| 4,538,222 | 8/1985 | Crain et al. . | |
| 4,671,892 | 6/1987 | Bereiter . | |
| 4,691,850 | 9/1987 | Kirschmann et al. . | |
| 4,845,965 | 7/1989 | Copeland et al. . | |
| 4,941,596 | 7/1990 | Marty et al. . | |
| 4,976,137 | 12/1990 | Decker et al. . | |
| 4,989,637 | 2/1991 | Dittrich | 137/341 |
| 5,020,917 | 6/1991 | Homan | 222/144.5 |
| 5,027,284 | 6/1991 | Senghaas et al. | 222/144.5 |
| 5,056,686 | 10/1991 | Jarrett | 222/144.5 |

FOREIGN PATENT DOCUMENTS

| | | |
|---|---|---|
| 0097458 | 1/1984 | European Pat. Off. . |
| 0196398A2 | 3/1985 | European Pat. Off. . |

*Primary Examiner*—A. Michael Chambers

*Attorney, Agent, or Firm*—Merchant, Gould, Smith, Edell, Welter & Schmidt

[57] ABSTRACT

A modular apparatus (10) for preparing dilute chemical compositions at the point of use, e.g., a customer's plant, is disclosed. The apparatus has upstream and downstream ends and includes an axial manifold (52) having a plurality inlet ports extending radially toward the center of the manifold, a valve (53) operatively connected to each inlet port, component supply conduits (18) operatively connected to the valve (53), at least one component supply vessel heater (23) proximate at least one liquid component supply container (12), a pump (56) in fluid communication with the manifold (52) to draw the liquid components into and through the manifold (52), a microprocessor controller (11) in communication with the valves (53) and (61) and pump (56), a flowmeter (60) in communication with the microprocessor (11) downstream of the manifold (52), a three-way valve (61) in fluid communication with the pump (55), and a container (70) which is in fluid communication with the three-way valve (61) in which the chemical composition is formed.

Also disclosed is a method for dispensing aqueous cleaning compositions at a point of use.

18 Claims, 8 Drawing Sheets

APPARATUS AND METHOD FOR MIXING AND DISPENSING CHEMICAL CONCENTRATES AT POINT OF USE

FIELD OF THE INVENTION

The invention generally relates to an on-site apparatus to prepare aqueous cleaning compositions. In particular, the apparatus is microprocessor controlled and is capable of delivering accurate volumes of chemical components over a wide range of operating conditions. Further, the apparatus may be operated with a time-based and flow-based redundant control for reliable performance.

BACKGROUND OF THE INVENTION

Multi-component aqueous cleaning compositions are widely used throughout industry. The cleaning chemical industry has traditionally employed large scale processes to manufacture dilute aqueous cleaners which are then shipped to customers' use locations. Obviously, the transportation of dilute aqueous compositions involves the movement of large volumes of dilute aqueous products which are predominantly water. It is recognized that significant savings in transportation expenses can be achieved if the cleaning compositions could be moved in a concentrated form. Thus, the cleaning chemical industry has begun supplying cleaning chemical concentrates to use locations.

Unfortunately, the users of these cleaners may not recognize the importance of proper dilution ratios of the cleaners or may not be capable of accurately forming the proper dilutions. This may result in the use of dangerously concentrated cleaning compositions or ineffectively or inefficiently diluted compositions at the cleaning site. In any event, it is difficult for the suppliers of the chemical concentrates to warrant their products without control of the often critical dilution step.

In addition, while many similar cleaning compositions have identical chemical components, their relative proportions may be different in the diluted cleaning product. Therefore, the producers of concentrated cleaning compositions must offer numerous cleaning concentrates for the various cleaning needs of a customer. Thus, the customer is left with storage areas which may become cluttered and confused with numerous similar cleaning concentrates which may be mistakenly selected and applied in an improper manner.

To overcome the above hazards and limitations, manufacturers of cleaning compositions have discovered methods of enabling their customers to produce dilute aqueous chemical cleaning compositions at their own plants. These methods usually employ some apparatus which prepares a variety of cleaning compositions from chemical concentrate tanks and a water supply. Often, these apparatus are microprocessor controlled so the supplier can program the preparation of cleaning compositions which are individually tailored for the particular customer's needs. Examples of such dispensers include portable devices as disclosed in Smith, U.S. Pat. No. 3,797,744, and mounted devices as disclosed in Kirschmann et al., U.S. Pat. No. 4,691,850; Marty et al., U.S. Pat. No. 4,941,596; Turner et al., U.S. Pat. No. 5,014,211; and Decker et al., U.S. Pat. No. 4,976,137.

The Smith patent discloses a portable cleaning and sanitizing system comprising a plurality of pressurized chemical component tanks which are connected to a manifold and conducted to a spray nozzle. The outlet of each component tank passes under pressure through a three-way valve, metering valve, flow indicator and control valve prior to entry into the manifold. The chemical components are delivered at various points along the length of the manifold. However, this system is designed for use in sequentially delivering a plurality of cleaning compositions prepared by concurrently withdrawing and diluting the chemical components. The system meters and controls the flow of individual chemical components to continuously form the cleaning spray.

The Kirschmann patent discloses a time-based chemical dispensing system comprising two manifolds and a pump to draw the chemical components through a distribution manifold. Valves are positioned to allow the pump to draw one chemical at a time through the distribution manifold for a specified time. The chemical is then delivered through an outlet manifold and to a container. Water is also delivered through the outlet manifold to make up the aqueous composition. Both manifold in the system are flushed after each chemical is dispensed, and the chemical input ports are arranged along the length of the manifold.

The Marty patent discloses a volume-based mixing system for use with concentrated liquids comprising a mixing manifold connected to a positive displacement pump. In the operation of this system, the manifold passageway is filled with water, a chemical concentrate supply valve to the manifold is opened, and the pump is operated to draw a predetermined amount of water or carrier fluid from the manifold, drawing an equal volume of chemical concentrate into the manifold. The pump is operated for a given number of cycles to deliver a specified volume of chemical concentrate. This system further comprises a pressure regulator to maintain a predetermined pressure on the water or carrier fluid to allow for control of the system. Again, the chemical concentrate inlet ports are arranged along the length of the manifold.

The commonly assigned Decker patent discloses a chemical mixing and dispensing system comprising a manifold having a plurality of chemical component inlet ports arranged along the length of the manifold. There are a plurality of chemical component supply pumps and valves for delivering the chemical components to the manifold under pressure. To provide quality control of the system, there are conductivity sensors, a weight measurement device at the filling station and electronic control means.

The Turner patent discloses a wash chemical dispenser delivery system employing a linear manifold for delivering a series of diluted chemicals to selected laundry machines in a network. Cleaning compositions are formed within the tub of each individual machine. There is a three-way valve located at each machine to control delivery to or bypass of the particular machine. Metering pumps deliver individual chemical concentrates to the manifold where they are simultaneously diluted with water, and these pumps are calibrated through a conductivity cell located downstream of the manifold. Quality control is obtained using proof of flow and proof of delivery conductivity meters at the outlet of the manifold and at the valves which deliver the chemicals to each machine. This device is time-based, in that delivery of the chemical concentrates is controlled by the time of operation of the metering pumps.

While the above dispensing systems are useful in many applications, each particular apparatus design incorporates compromises between competing functions and controls. Thus, new dispensing systems are constantly needed which can offer particular advantages in particular applications having given operating requirements. The prior art discloses a number of different dispensing systems having particular geometries and control systems. However not one of these references teaches a dispenser having redundant time- and flow-based operating controls. Further, the dispensing systems discussed above have use under particular operating conditions, but not one of the references teaches a dispensing system which has time- and flow-based controls and is accurately operable to produce a wide variety of cleaning compositions over a large volume range.

SUMMARY OF THE INVENTION

The invention is directed to a modular apparatus for preparing chemical compositions at the point of use, e.g., a customer's plant. The apparatus includes an axial manifold having first and second ends, having a plurality inlet ports extending radially toward the center of the manifold. Control valves are located at the inlet ports to control the supply of chemical concentrates into the manifold, and the concentrates are drawn into the manifold by the operation of a positive displacement pump. A three-way valve operates to direct the flow of the concentrates into or bypassing a container located at a filling station in which the chemical composition is formed. A microprocessor controller manages the operation of the dispensing system and receives information from a flowmeter situated downstream of the axial manifold. The apparatus may be used to form dilute aqueous chemical compositions, or mixtures of chemical concentrates without added water.

The invention also involves a method for forming chemical compositions. The method can be performed using a microprocessor controller. In performance of the method, a composition to be produced is selected, and the microprocessor organizes the delivery of the particular chemical concentrates to a container in a filling station. The delivery occurs by operating selected chemical concentrate supply valves, a three-way valve and a positive displacement pump to draw the components through a manifold and to the container. Excess quantities of the components are directed away from the container by the operation of the three-way valve. Both the time of operation of the particular component supply valves, three-way valve and positive displacement pump and the volume of component delivered through the manifold are measured and reported to the microprocessor controller and can be used to control the operation of the unit.

The combination of the manifold and positive displacement pump means provides precise liquid delivery at a wide variety of operating conditions. This results in greater quality control and assurance using the apparatus. The microprocessor and flowmeter provide redundant system controls to also improve quality assurance, and the three-way valve can operate in conjunction with the flowmeter to provide precise determinations of the amounts of liquid delivered to the filling station. Finally, the modular nature of the inlet port valve means and the pump means provide improved installation and maintenance of the unit.

DETAILED DESCRIPTION OF THE INVENTION

Figure 1:
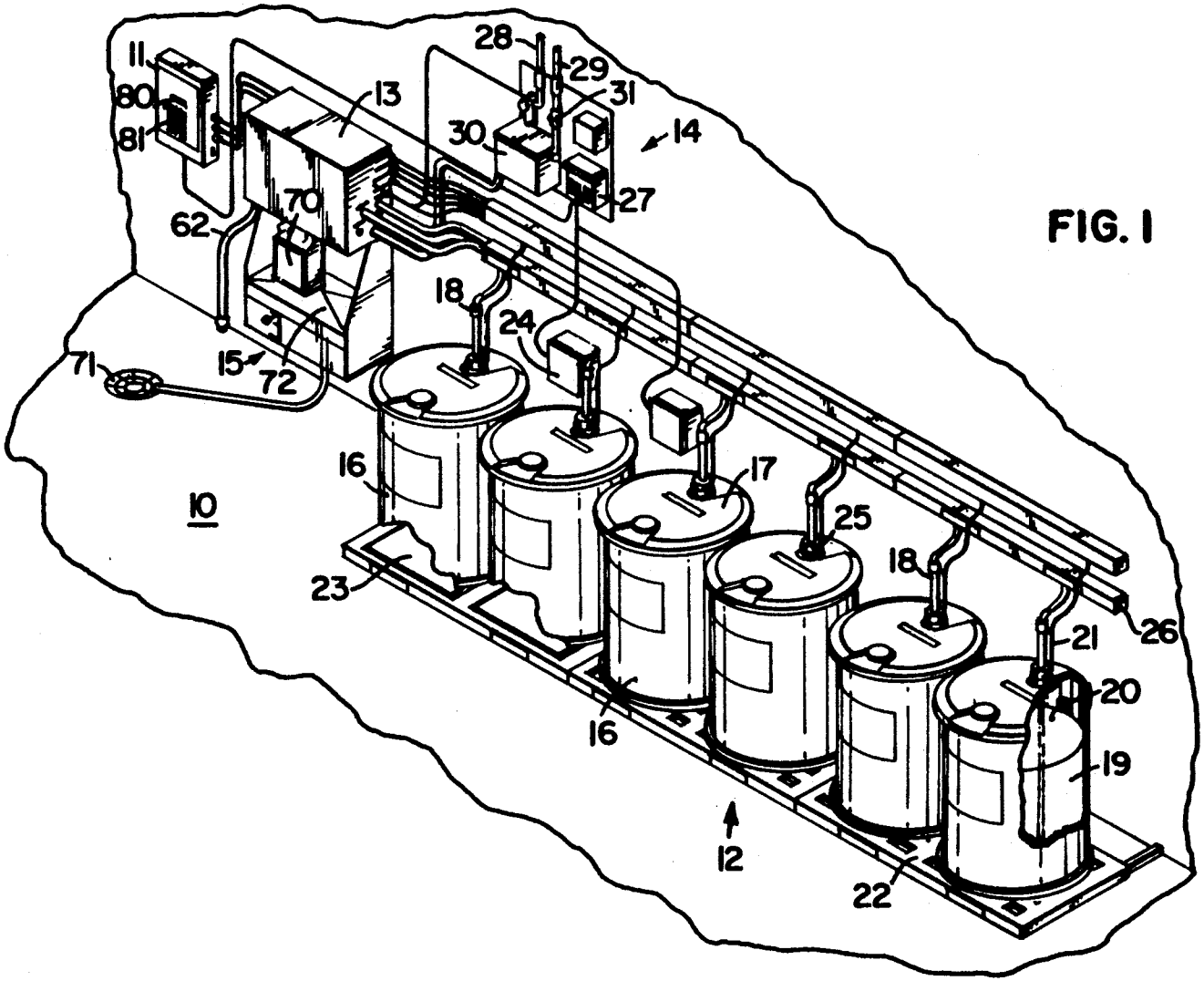
FIG. 1 is a perspective view of a dispenser apparatus according to the invention.

Referring to the drawing, wherein like numerals represent like parts throughout the several views, there is generally disclosed at 10 in FIG. 1 a cleaning composition dispenser. The dispenser comprises a microprocessor control 11, component supply vessels 12, a pump station 13, a service station 14, and a fill station 15. In a preferred embodiment, the microprocessor control 11, pump station 13, service station 14 and fill station 15 are mounted on a wall or other vertical surface while the component supply vessels 12 are located at floor level. The component supply vessels 12 are preferably clearly labeled with the identification of the concentrate contained therein and comprise plastic drums 16 having tight fitting covers 17, a conduit 18 for the removal of concentrated liquid chemicals contained therein 19, and a fluid level sensor 20 to measure the amount of component 19 within the supply vessel 12. The fluid level sensor 20 is connected to the microprocessor by means of a cable 21. The supply vessels 12 are also preferably placed on a grate 22 which may incorporate a heater 23 controlled by a thermostat 24. This heater 23 is especially useful for chemical concentrates which may crystalize or are of high viscosities at or near usual ambient temperatures, i.e., a 50% by weight sodium hydroxide solution in water.

As indicated above, the chemical supply vessels 12 have disposed therein a conduit 18 for removing the chemical concentrate. Preferably, the conduit 18 is affixed to the supply vessel cover 17 by means of a coupling 25 such as a bolted flange or other type of fitting. On the exterior of the supply vessels 12, the conduit 18 may be a pipe or flexible plastic hose. To protect and support the conduit 18 between the supply vessel 12 and the pumping station 13, it is preferred that the conduit 18 be directed through a covered channel 26 mounted on a wall or other vertical surface at or above the elevation of the top of the supply vessel. This channel also provides means to achieve a constant hydraulic line loss wherein length and elevation are constant. Preferably, the conduit 18 is made of tubing or hose which can operate at vacuum such that the chemical concentrates may be drawn through the conduit 18 from the supply vessel 12 and through the pumping station 13. Preferred materials for the conduit 18, both within and outside the supply vessels 12, comprise polypropylene, polyvinylidene fluoride, high density polyethylene, EVA copolymer, fluoroelastomer, perfluoroelastomer, polyvinyl chloride, and chlorinated polyvinyl chloride. More preferably, the conduit is wrapped, wound, or braided with reinforcing fibers. Most preferably, the conduit comprises braided EVA tubing.

The service station 14 provides access to air, water and electrical supplies. The electricity source 27 powers the microprocessor controller 11, the pumping station 13, and heaters 23 which may be used as discussed above. The pressurized air supply 28 energizes the dispenser valves in the pump station 13. While any pressure may be used to actuate the valves, we have found that regulating the air pressure at the service station 14 to about 75 to 90 psig is preferred to establish precise control of the dispenser apparatus. More preferably, the air pressure is regulated at about 90 psi at the service station 14 to operate the dispenser system. Further, it is preferred that the air be available at at least about 0.5 standard cubic feet per minute (SCFM).

Water is supplied to the dispenser system through a water port 29. Preferably, the water port 29 supplies water at a minimum of 2.5 gallons per minute, more preferably at a minimum of 3 gallons per minute. Water delivery pressure is preferably at least about 20 psig, and more preferably about 40 psig. While normal service water may be used, it is preferred that soft water be used. Preferably the water has a hardness of about 15 grain or less. Further, in a preferred embodiment, the service station 14 has a water holding tank 30 to provide an unpressurized source of water which may be drawn to the pumping station 13. The water holding tank 30 preferably has a level sensor (not shown) which opens and closes a water supply valve 31 to maintain relatively constant level of water in the holding tank 30.

The use of a water reservoir is helpful to allow all cleaning composition components to be drawn into the axial manifold 52. If the water is supplied to the manifold 52 and pump 56 under positive pressure, transition errors can be introduced into the dispensing errors. The errors would result from the transition between pumping a liquid delivered to the manifold 52 under positive pressure (water) and a liquid drawn into the manifold 52 under negative pressure (chemical components 19).

Figure 2:
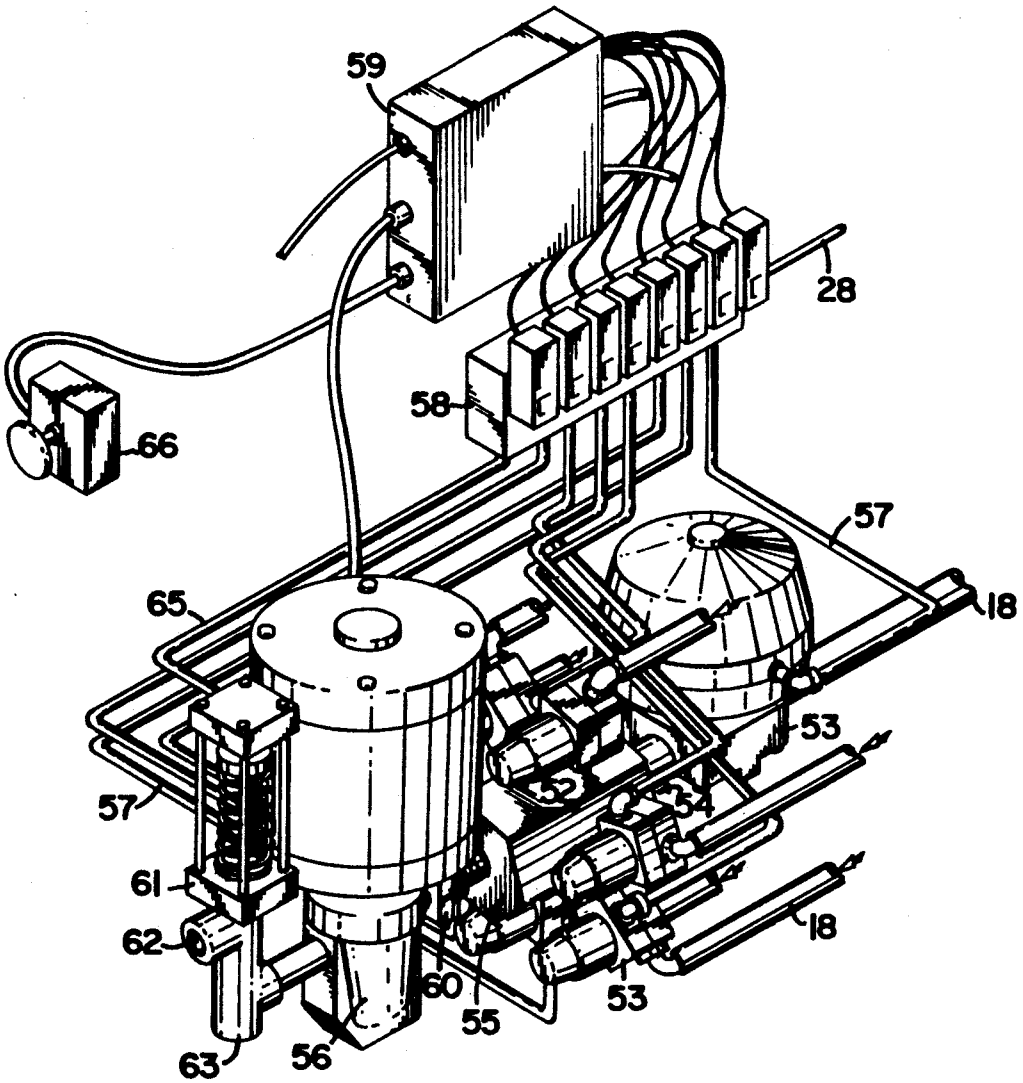
FIG. 2 is a perspective view of the pumping station of the dispenser apparatus of FIG. 1.
Figure 5:
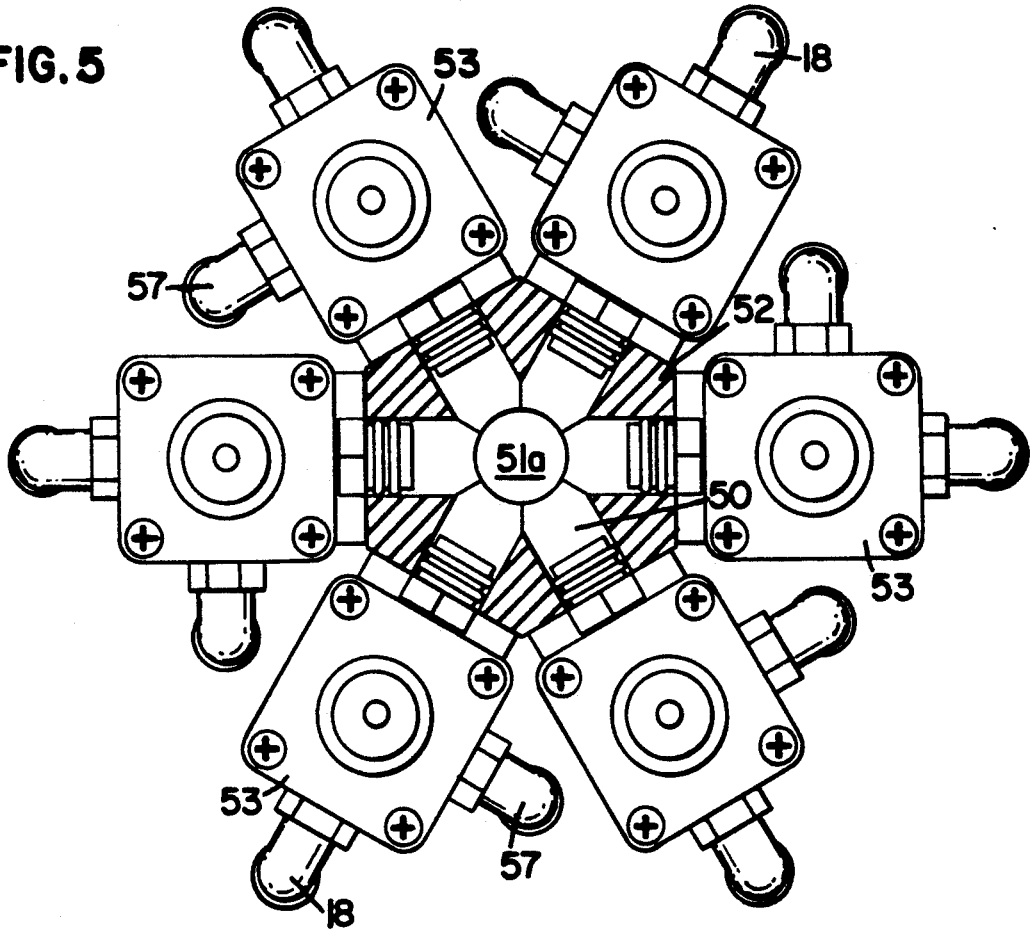
FIG. 5 is a sectional view of the axial manifold of the pumping station of FIG. 2.

The interior of the pumping station 13 is shown in FIG. 2. The conduits 19 from the supply vessels 12 provide an entry for the chemical concentrates 19 into the pumping station 13. The conduits 19 are in fluid communication with radial inlet ports 50 and an end inlet port 51 of an axial manifold 52 and are regulated by means of pneumatic valves 53 attached to the axial manifold's inlet ports 50 and 51. The manifold is illustrated in greater detail in FIG. 5. Preferably, these valves 53 are attached with a thumb screw (not shown) to removably engage the manifold 52.

The radial inlet ports extend radially toward the center of an axial manifold 52 and include at least one water inlet port. Preferably, the manifold 52 has first and second ends 54 and 55, a longitudinal axis extending through the first and second ends, and the manifold defines a bore 51*a* extending longitudinally through the first and second ends. The radial inlet ports 50 are all preferably positioned an equal distance from the second or outlet end 55 of the longitudinal bore 51*a*, and the end inlet port 51 is positioned at the first or upstream end 54 of the longitudinal bore 51*a*. This arrangement allows for improved quality and control of the dispensing of the chemical concentrates 19. As the radial inlet ports 50 are all located equidistant from the outlet end 55 of the manifold 52, there is no variability in component volume contained within the manifold 52 for any of the radially inlet components. In addition, the end inlet port 51 may be larger to economically accommodate chemical concentrates which are to be delivered at relatively high density viscosity, or both to achieve commensurate volumetric delivery by the pump 56 described below. In addition, the geometry of the manifold 52 and radial inlet ports 50 provides for improved flushing of the manifold 52 when water is directed into the manifold 52 through one of the radial inlet ports 50. Thus reduced time is required to sufficiently flush the manifold 52.

The inlet port pneumatic valves 53 are controlled by air pressure in delivery lines 57 which are connected to a pneumatic manifold 58. The pneumatic manifold 58 is supplied by pressurized air supply 28 at the service station 14. The pneumatic manifold 58 is also in communication with and controlled by a relay station 59 which is in turn in communication with an controlled by the microprocessor control 11.

As indicated above, the chemical concentrates 19 are moved through the dispensing apparatus by means of a pump 56. Preferably, the pump is a positive displacement metering pump. More preferably, this pump is a rotary pump, and most preferably, it is a gear pump. Further, it is preferred that the positive displacement pump have a rated capacity of 0.7 to 5.6 gallons per minute. More preferably, the pump has a rated capacity of 1 to 4 gallons per minute, and most preferably, about 2 gallons per minute. While the rated capacity roughly indicates the pump's delivery, the capacity may certainly be altered by varying the pump speed.

Downstream of the axial manifold 52, but before the pump 56, is a flowmeter 60 to measure the volumetric flow of the components being drawn through the manifold 52. Preferably, this flowmeter 60 is a digital flowmeter capable of generating a signal which may be input into a microprocessor control 11.

After fluids are drawn through the axial manifold 52 by means of the positive displacement pump 56, they may be delivered through a three-way valve 61 which can operate in a by-pass mode by sending the fluid through conduit 62. Alternatively, the valve 61 may direct the fluid to a filling station 15 via conduit 63. The three-way valve 61 and pneumatic inlet port valves 52 are controlled in response to pneumatic input from pneumatic manifold 58. The pneumatic manifold 58 is connected to the pressurized air regulator 28 located at the service station 14. Upon instruction from the relay 59, the pneumatic manifold 58 delivers pressurized air through the pneumatic line 57 to the selected valve 53. This opens and closes the selected pneumatic control valve 53. The pneumatic control also shuttles the three-way valve 61 between the by-pass conduit 62 and delivery conduit 63 by means of pneumatic line 65.

As indicated above, the relay station 59 is in communication with the pneumatic manifold 58 to control the inlet port control valves 53 and the three-way valve 61. The relay station is also in communication with the metering gear pump 56 to control its operation. Of course, the relay station 59 is in communication with the microprocessor control station 11 from which instructions are received to control the various components of the pumping station 13. Finally, in electrical communication with the relay 59, a pumping station kill switch 66 operates as a safety switch to allow the operator to de-energize the system as the need arises.

As shown in FIG. 1, the filling station 15 is preferably also mounted to the wall below the pumping station 13. The filling station 15 may accommodate smaller containers 70, e.g., smaller than about 5 gallons. Typically, the containers 70 filled at the filling station 15 comprise 1½ gallons, 2½ gallons and 5 gallon containers. If larger containers are to be filled, they can be positioned outside of the filling station 15 in fluid communication with the by-pass conduit 62. In this manner, drums as large as 55 gallons or larger may be filled using the chemical cleaner dispenser. In other modes of operation, the by-pass conduit 62 may be directed to a floor drain or other waste conduit 71, as illustrated in FIG. 1. Further, the filling station 15 has incorporated therein a catch pan 72 to collect liquid which may spill in the filling station 15. This catch pan also drains to a floor drain or other waste conduit 71.

The dispenser apparatus 10 is controlled by a microprocessor control 11 which is in communication with the relay 59 in the pumping station 13 and other process control points such as temperature sensors (not shown), supply vessels 12, the flowmeter 60, air and water pressure sensors (not shown), etc. The microprocessor control 11 preferably includes timing means whereby the operation of the apparatus may be performed on a time basis. In other words, the microprocessor control 11 may be operated to control the operation of the pneumatic valves 50 and 51, the three-way valve 61, and the metering pump 56 for predetermined time periods to dispense the desired dilute composition. As also discussed above, the microprocessor control 11 is in communication with the flowmeter 60 or means to measure fluid flow downstream of the manifold. Thus, the flowmeter 60 can generate signals for the microprocessor control 11 wherein the dispenser apparatus may be controlled on a flow based system.

The liquid components 19 of in the containers 12 may include such compositions as caustic solutions, e.g., any caustic compound solution cleaning compositions such as sodium hydroxide or potassium hydroxide and alkali metal silicates, phosphate and non-phosphate built materials, foaming and non-foaming surfactants, bleaches, etc. These components may be combined in various proportions to form non-foaming alkaline cleaners with and without wetting agents, non-foaming chlorinated alkaline cleaners with and without wetting agents, foaming chlorinated alkaline cleaners, foaming chlorinated built alkaline cleaners, heavy duty alkaline cleaners with and without wetting agents, chlorinated heavy duty alkaline cleaners, liquid sanitizers, foaming heavy duty alkaline cleaners, heavy duty acid cleaners, foaming acid cleaners, as well as non-phosphate versions of the above.

A circuit board in the control unit 11 contains the microprocessor electronics which provide the control functions for the dispenser. A LCD display 80 is mounted to the front of the control unit and displays information to the operator in response to the keying of information on a keyboard 81. A power supply 27 supplies proper levels of power for the various components described above.

In the preferred embodiment, the microprocessor 11 of the present invention also includes memory means which automatically inventories the type and quantity of product dispensed. This allows the operator to accurately monitor and control inventory. The apparatus can further be provided with an IEEE-488 standard modem (not shown) to transmit inventory and use information to a remote location for trouble-shooting and billing purposes.

Figure 3A:
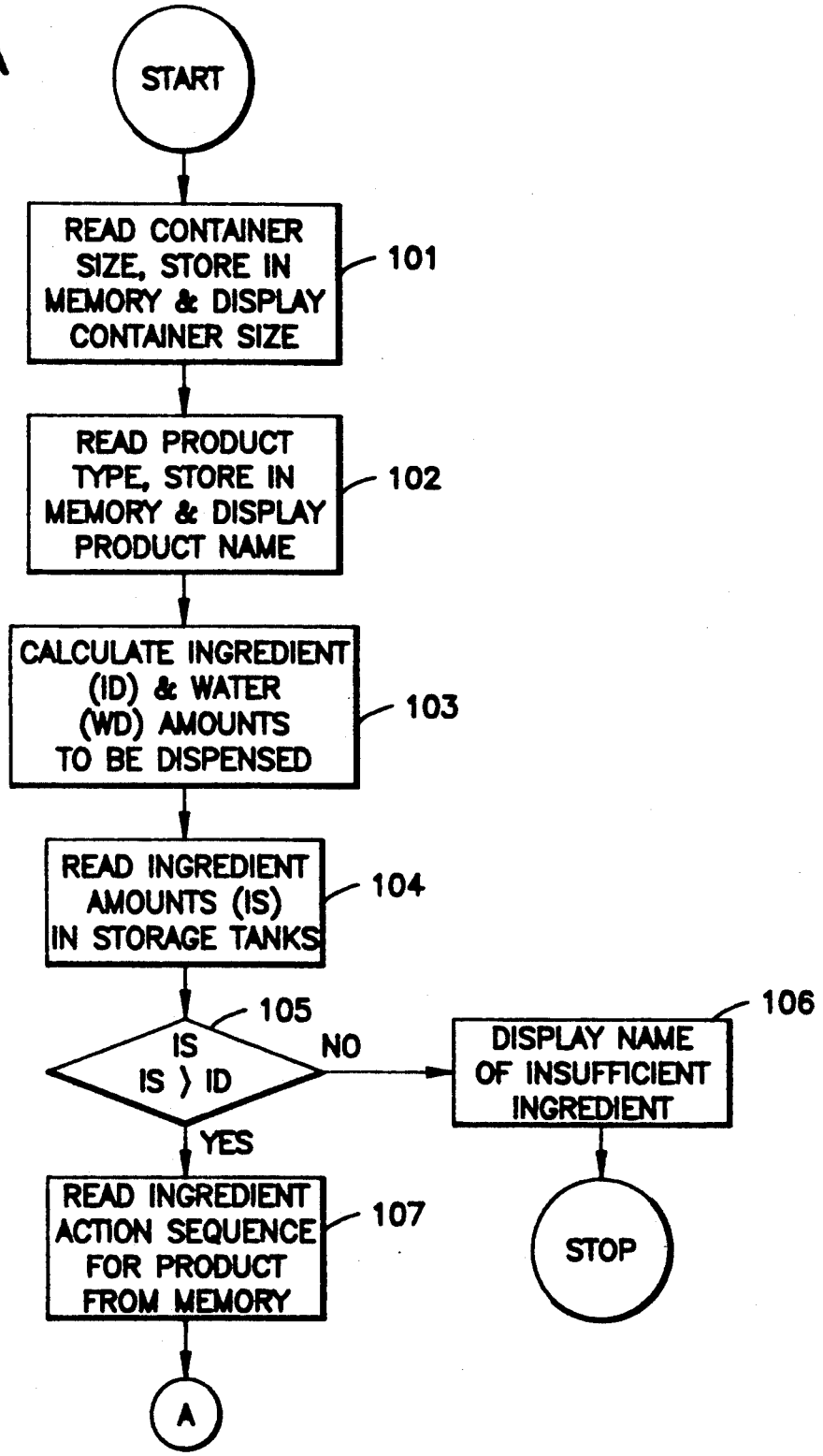
FIGS. 3A-3D are a flow chart outlining the operation of the microprocessor controller of FIG. 1.

Referring now to FIG. 3A, in operation, an operator presses the "on" switch and selects the container size and product desired using the keyboard 81. The operator then places the container 70 in the filling station 15 and inserts a filling tube (not shown) into the mouth of the container. The "start" button is then pressed which begins the dispensing operation, block 100.

The container size is read from memory, displayed on the LCD display 80 and stored in the inventory control memory, block 101. The product type is also read from memory, displayed on the LCD display 80 and stored in the inventory control memory, block 102. The microprocessor control 11 then creates an ordered list of ingredients to be dispensed and calculates the ingredient and water amounts required for the desired product, block 103. This amount is compared with the amounts available in the ingredient storage vessels 12, blocks 104 and 105. If any of the ingredients is not available in sufficient quantity, the display indicates the insufficient ingredient, block 106. If the ingredients are all available in sufficient quantity for the desired product, the program proceeds to prepare the product, block 107.

Figure 3B:
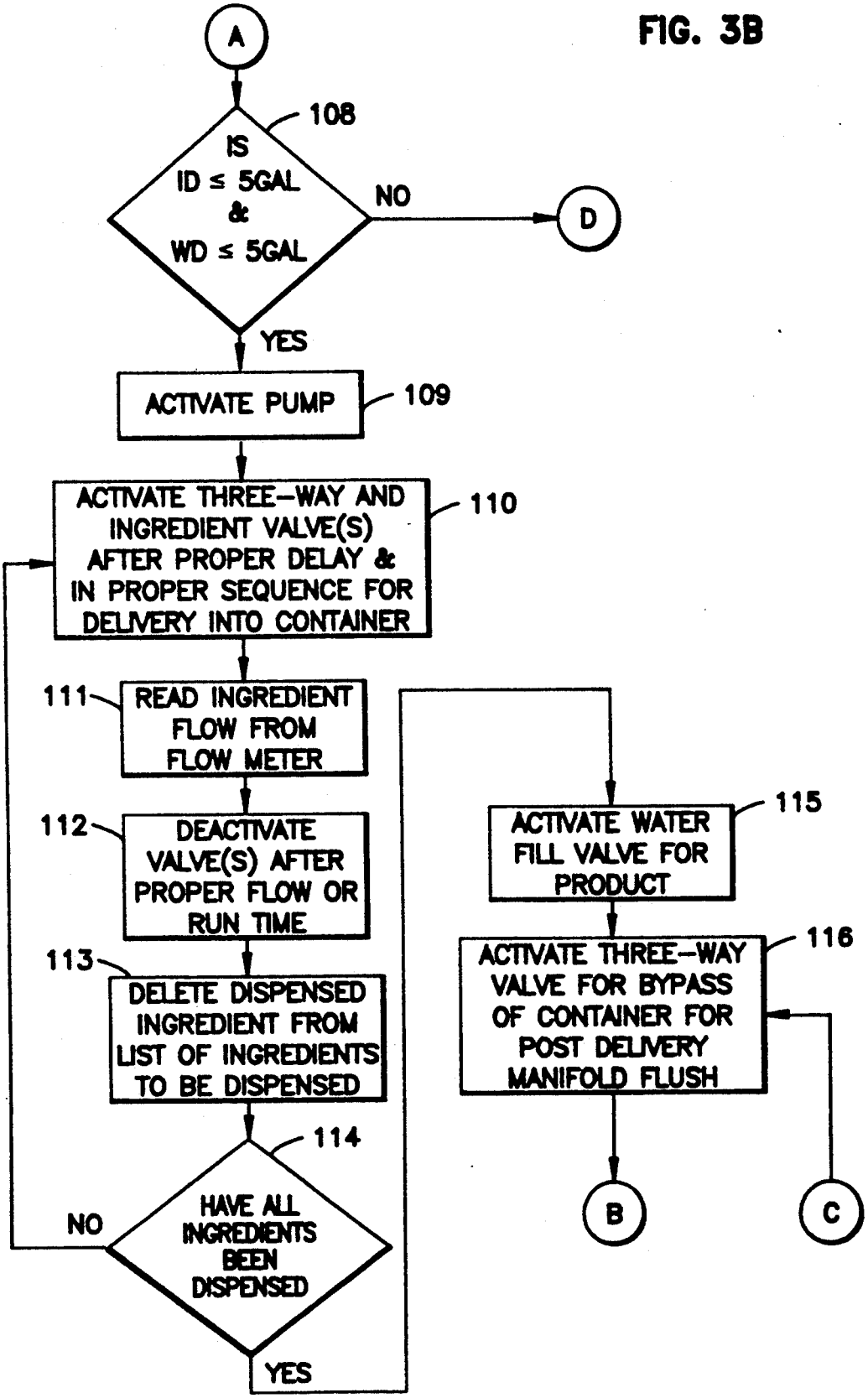

Referring to FIG. 3B, if the quantity of the desired product is about 0.25 and 5 gallons, the dispenser proceeds in a continuous mode, i.e., the concentrates are sequentially drawn through the manifold 52 and directed to the container 70. If the quantity of the desired product is greater than about 5 gallons, the dispenser proceeds in a semi-continuous mode, i.e., the concentrates are drawn individually through the manifold 52 to establish a steady flow, the three-way valve 61 is opened to dispense the concentrate, and then the flow is diverted until the steady flow of the next concentrate is established, block 108.

In a continuous mode, the pump 56 is activated, block 109, and at least one inlet port valve 53 for a chemical concentrate is activated to allow the concentrate to be drawn through the manifold 52, and the three-way valve 61 is activated to direct the concentrate into the container 70, block 110. The concentrate flow is measured by means of a digital flowmeter 60, and the output of the flowmeter 60 is read into the controller 11, block 111. After the proper time and/or flow, the inlet port valve 53 is deactivated, the ingredient is deleted from the list of ingredients to be dispensed, and the next ingredient is dispensed as described above, blocks 112, 113 and 114.

When all chemical concentrates have been dispensed, the inlet port valve 53 for water is activated to dispense the desired amount of water to dilute the product, block 115. After the proper amount of water has been delivered to the container 70, the three-way valve 61 is again activated to bypass the container 70, and a short flush of water is diverted to the floor drain 71, block 116. Thus, residues of the potentially corrosive chemical concentrates are prevented from attacking the manifold 52, pump 56, and valves 53 and 61 of the apparatus. Finally, the pump 56 is deactivated, signalling the end of the dispensing process, block 117, as shown in FIG. 3D. Of course, the water need not be supplied to the container 70 only at the end of the sequence. It may also be treated as one of the chemical concentrates 19. A graphical example of the preparation of a cleaning composition according to this procedure is illustrated in FIG. 4.

Figure 4:
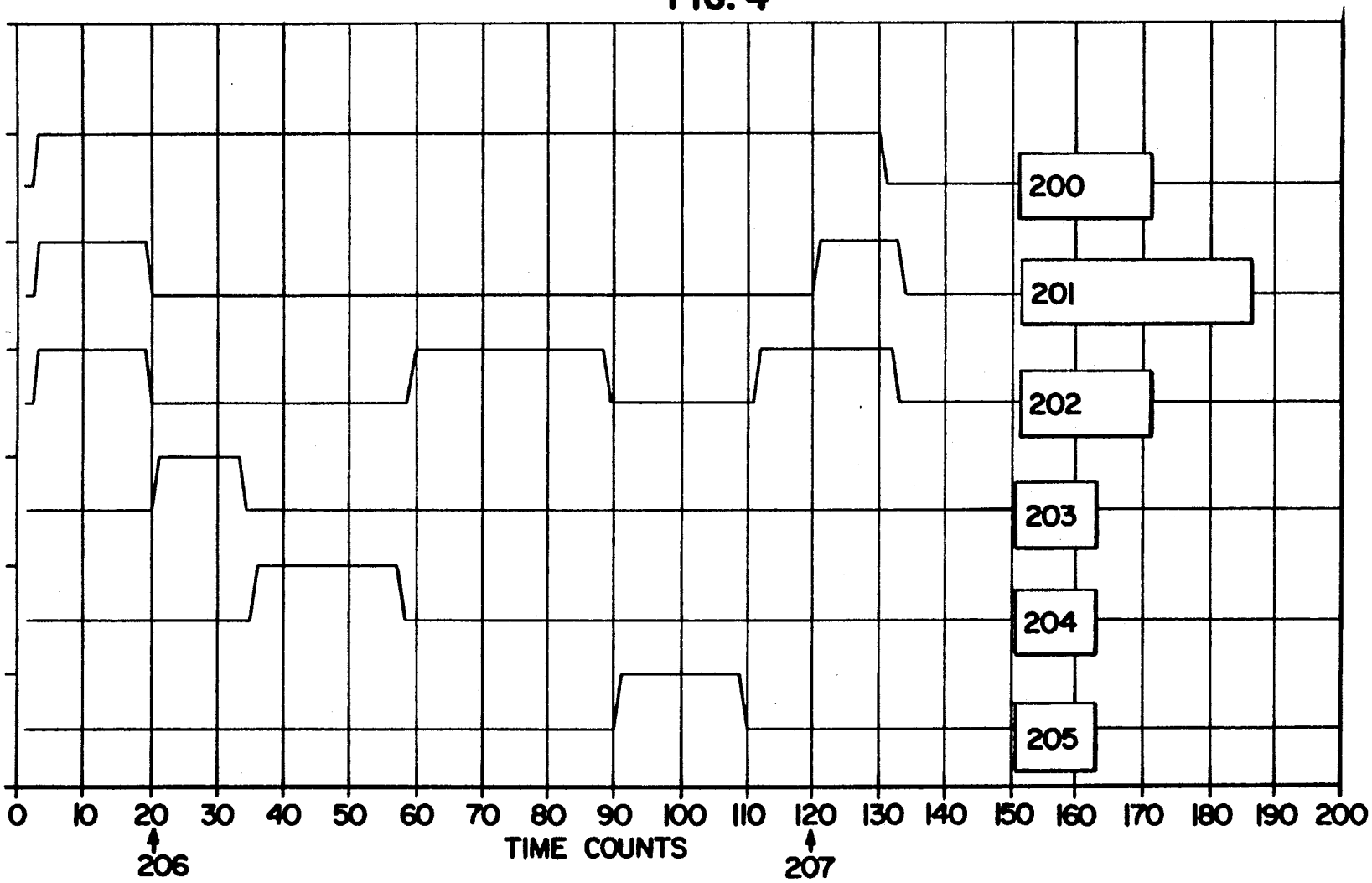
FIG. 4 is a graphical representation of the operation of the dispenser in a time-based mode.

FIG. 4 illustrates another possible operation of the dispenser of FIG. 1. In particular, each labelled, generally horizontal line in the figure represents the operation of the indicated equipment. Higher levels of the line indicate the operation of the particular device. The top line 200 represents the pump 56, and illustrates the operation of the pump 56 from just after time 0 to time 130. The next line 201 indicates the operation of the three-way valve 61. The upper position of the line indicates the operation of the valve 61 in the bypass mode, directing fluid flow to the bypass conduit 62, and the lower position of the line indicates the direction of fluid flow through the delivery conduit 63. The third horizontal line 202 represents the action of the radial inlet port valve 53 controlling water flow. The fourth line 203 represents the action of the radial inlet port valve 53 controlling the flow of a first chemical concentrate, concentrate 1, The fifth line 204 represents the action of the radial inlet port valve 53 controlling the flow of concentrate 2, and the sixth line 205 represents the action of the radial inlet port valve 53 controlling the flow of a first chemical concentrate, concentrate 3. The delivery of the formula is accomplished between time 20, shown at 206, and time 120, shown at 207. It can be seen from these operation lines 200 through 205, that there is an initial manifold flush with the delivery of water through the bypass conduit, then a sequential delivery of concentrate 1, concentrate 2, water, concentrate 3, and a final delivery of water to form the dilute chemical composition, after which the three-way valve 61 operates to divert the water to the bypass conduit 62 in a final manifold flush.

After the dispensing is completed, the container 70 can be removed and transported to storage or to a use site, where substantially all of the cleaning composition is used, block 118. In addition, the product and quantity delivered can be stored in the microprocessor memory, block 129, for inventory control, billing, etc.

Figure 3C:
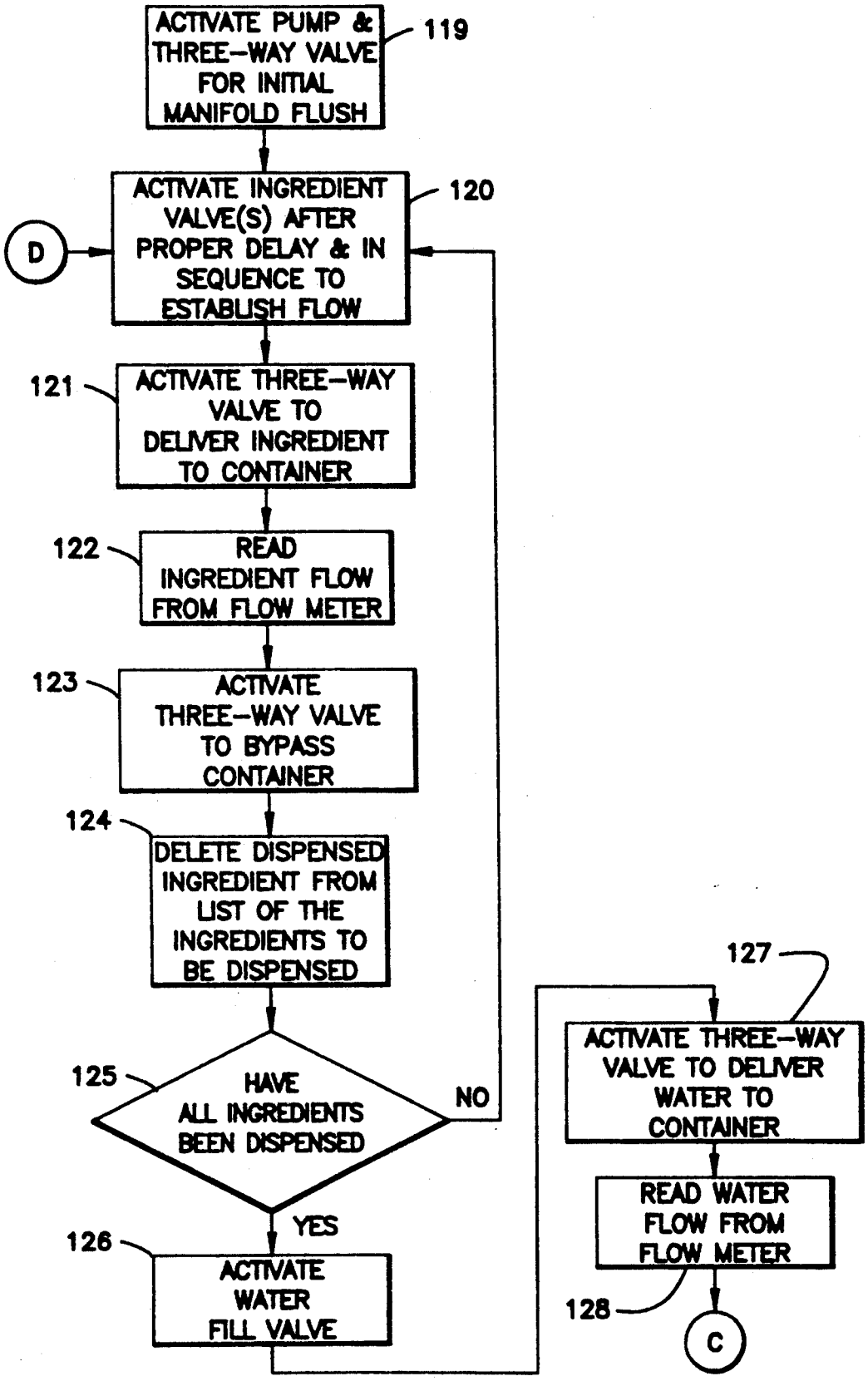
Figure 3D:
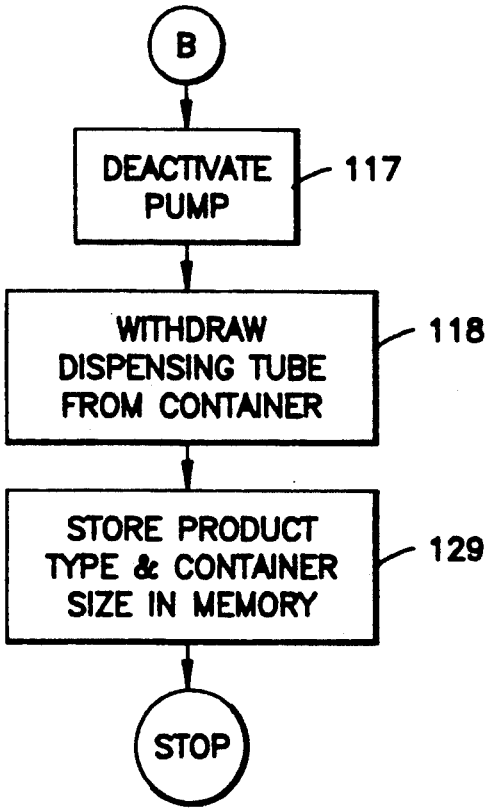

In a semi-continuous mode, the pump 56 and three-way valve 61 are activated for a predetermined time to provide a manifold flush which bypasses the container 70 to a floor drain 71, block 119, as shown in FIG. 3C. Next, at least one inlet port valve 53 for a chemical concentrate 19 is activated to allow the concentrate 19 to be drawn through the manifold 52 and to establish a steady flow, block 120. Once the steady flow of the concentrate 19 is achieved, the three-way valve 61 is activated to direct the concentrate 19 into the container 70, block 121. The concentrate flow is measured by means of a digital flowmeter 60, and the output of the flowmeter 60 is read into the controller 11, block 122. After the proper time and/or flow, the three-way valve 61 is activated to bypass the container 70, the ingredient is deleted from the list of ingredients to be dispensed, and the next ingredient is dispensed as described above, blocks 123, 124 and 125.

When all chemical concentrates have been dispensed, the inlet port valve 53 for water is activated to allow the water to achieve a steady flow through the manifold 52, block 126. Once steady flow has been achieved, the three-way valve 61 is again activated to dispense the desired amount of water to dilute the product, block 127, and the flow of water is detected by the flowmeter 60 and read to the microprocessor 11, block 128. After the proper amount of water has been delivered to the container 70, the three-way valve 61 is activated to bypass the container 70, and a short flush of water is again diverted to the floor drain 71, block 116. The semi-continuous process proceeds as described above for the continuous process.

Although the present invention has been described with reference to one particular embodiment, it should be understood that those skilled in the art may make many other modifications without departing from the spirit and scope of the invention as defined by the appended claims.

What is claimed is:

1. A method for forming chemical compositions, the method comprising:

(a) selecting a composition to be produced using a microprocessor controller;

(b) delivering a plurality of liquid components by energizing a plurality of liquid component supply valves while energizing a positive displacement pump to sequentially draw the liquid components through the manifold;

(c) directing predetermined quantities of the liquid components into a container at a filling station to form the chemical composition;

(d) directing excess quantities of the liquid components away from the container;

(e) measuring the flow of the liquid components delivered;

(f) measuring the delivery time of the liquid components; and (g) reporting the liquid component flow and time measurements to the microprocessor controller.

2. The method of claim 1 further comprising controlling the time of delivery of the liquid components.

3. The method of claim 2 further comprising controlling the volume of the liquid components delivered wherein delivery errors are detected.

4. The method of claim 1 further comprising controlling the volume of the liquid components delivered.

5. The method of claim 4 further comprising controlling the time of delivery of the liquid components wherein delivery errors are detected.

6. The method of claim 1 further comprising directing a liquid component away from the container to establish a steady liquid flow, then directing the predetermined amount of the liquid component to the container, and again directing the liquid component away from the container, wherein delivery accuracy of low delivery amounts is achieved.

7. The method of claim 1 further comprising flushing the manifold with one of the liquid components after delivery of the other components is essentially complete.

8. The method of claim 7 wherein the flushing component is water.

9. The method of claim 7 wherein the water flush is directed to a drain.

10. The method of claim 7 wherein the water flush is directed into the dilute chemical composition.

11. A method for forming chemical compositions, the method comprising:

(a) selecting a liquid composition prepared from selected liquid components to be produced using a microprocessor controller;

(b) opening a liquid component supply valve while energizing a positive displacement pump to draw a liquid component through the manifold;

(c) measuring the flow of the liquid component delivered;

(d) measuring the delivery time of the liquid component;

(e) reporting the liquid component flow and time measurements to the microprocessor controller;

(f) closing the liquid component supply valve after a predetermined quantity of the liquid as measured by the flow detection device;

(g) insuring the closure of the liquid component supply valve after a predetermined time;

(h) directing the predetermined quantity of the liquid component into a container at a filling station; and (i) repeating steps (b)–(h) for each component in the liquid composition.

12. The method of claim 11 further comprising flushing the manifold with one of the liquid components after delivery of the other components is essentially complete.

13. An apparatus for preparing chemical compositions, the apparatus having upstream and downstream ends comprising:

(a) a manifold having first and second ends, a longitudinal axis extending through the first and second ends, the manifold defining a bore extending longitudinally through the first and second ends and having a plurality radial inlet ports extending radially inward to the longitudinal bore, the inlet ports being arranged and configured in an equidistant manner with respect to the second end of the longitudinal bore whereby the radial inlet ports and axial manifold provide an essentially constant geometry for components delivered through the radial inlet ports;

(b) valve means operatively connected to the inlet ports;

(c) components supply means operatively connected to the valve means wherein liquid components are transported from liquid component supply containers to the manifold;

(d) pump means in fluid communication with the manifold to draw liquid components into and through the manifold;

(e) microprocessor means in communication with the valve means and pump means;

(f) a flow measurement device in communication with the microprocessor means downstream of the manifold; and (g) three-way valve means in fluid communication with the pump means and having two outlet conduits.

14. The apparatus of claim 13 wherein the inlet port valve means comprises a pneumatic valve.

15. The apparatus of claim 3 wherein flow measurement device is located downstream of the manifold and upstream of the pump means.

16. The apparatus of claim 1 wherein the three-way valve is located downstream of the pump means.

17. The apparatus of claim 13 further comprising component heating means proximate at least one liquid component supply container.

18. The apparatus of claim 13 further comprising a container in fluid communication with one of the outlet conduits of the three-way valve means.

* * * * *